US007543398B2

(12) United States Patent
Hsaio et al.

(10) Patent No.: US 7,543,398 B2
(45) Date of Patent: Jun. 9, 2009

(54) WATERPROOF AND BREATHABLE INSOLE

(75) Inventors: Chung-Hu Hsaio, Taichung (TW); Chien-Wen Hsu, Taichung County (TW)

(73) Assignee: MJC Probe Incorporation, Hsinchu Hsiang (TW)

( * ) Notice: Subject to any disclaimer, the term of this patent is extended or adjusted under 35 U.S.C. 154(b) by 690 days.

(21) Appl. No.: 11/355,184

(22) Filed: Feb. 16, 2006

(65) Prior Publication Data

US 2007/0186444 A1 Aug. 16, 2007

(51) Int. Cl.
*A43B 23/07* (2006.01)

(52) U.S. Cl. ..... 36/55; 36/14; 36/3 R

(58) Field of Classification Search ..... 36/14, 36/55, 12, 44, 3 R, 3 B; 12/142 RS, 142 T
See application file for complete search history.

(56) References Cited

U.S. PATENT DOCUMENTS 1,390,929 A * 9/1921 Saudino ..... 36/3 R
1,718,756 A * 6/1929 Mosquit ..... 36/3 A
2,109,324 A * 2/1938 Tebbutt ..... 36/171
5,933,896 A * 8/1999 Gallina ..... 12/142 P
6,055,745 A * 5/2000 Endoh ..... 36/12
6,446,360 B1 * 9/2002 Sheets et al. ..... 36/55
6,978,559 B2 * 12/2005 Chu et al. ..... 36/55
7,370,382 B2 * 5/2008 Polegato Moretti ..... 12/142 T
2001/0049886 A1 * 12/2001 Chen ..... 36/12
2005/0193593 A1 * 9/2005 Chu et al. ..... 36/55

* cited by examiner

*Primary Examiner*—Marie Patterson
(74) *Attorney, Agent, or Firm*—Browdy and Neimark, P.L.L.C.

(57) ABSTRACT

A waterproof and breathable insole includes a shoe lining with two bottom side edges respectively curved inwards, an insole, which is peripherally stitched to the border area of the shoe lining and has two projections longitudinally arranged at two sides respectively attached to the bottom side of the bottom side edges of the shoe lining and defining with the bottom side edges of the shoe lining a plurality of gaps for ventilation, and a pad, which has a layer of waterproof and breathable material and is bonded to the whole area of the outside wall of the insole and a part of the shoe lining with a layer of non-waterproof and breathable glue.

10 Claims, 6 Drawing Sheets

WATERPROOF AND BREATHABLE INSOLE

BACKGROUND OF THE INVENTION

1. Field of the Invention

The present invention relates to shoes, and more particularly, to a waterproof and breathable insole.

2. Description of the Related Art

Various waterproof shoes are commercially available. A waterproof shoe generally has a shoe lining and an insole. The shoe lining and the insole are stitched together. In order to provide the desired waterproof effect, the bottom wall of the insole is coated with layer of waterproof glue. This layer of waterproof glue has a certain hardness and does not breaths. Therefore, a waterproof shoe of this design has a poor breathing effect. If a flexible layer of breathable glue is used for the insole of a shoe, the shoe does not have a waterproof characteristic.

SUMMARY OF THE INVENTION

The present invention has been accomplished under the circumstances in view. The object of the present invention is to provide a waterproof and breathable insole for shoe, which has waterproof and breathable characteristics.

To achieve this object of the present invention, the waterproof and breathable insole comprises a shoe lining, which has two bottom side edges respectively curved inwards, an insole, which is mounted inside the shoe lining and, which has a flat elongated insole body fitting the toes, transverse arch and plantar arch of the user's foot and peripherally stitched to said shoe lining, a rear heel portion extending backwards from the flat elongated insole body, and two projections longitudinally arranged at two sides respectively attached to the bottom side of the bottom side edges of the shoe lining and defining with the bottom side edges of the shoe lining a plurality of gaps for ventilation, and a pad, which has a layer of waterproof and breathable material and is bonded to the whole area of the outside wall of the insole and a part of the shoe lining with a layer of glue.

DETAILED DESCRIPTION OF THE INVENTION

Figure 1:
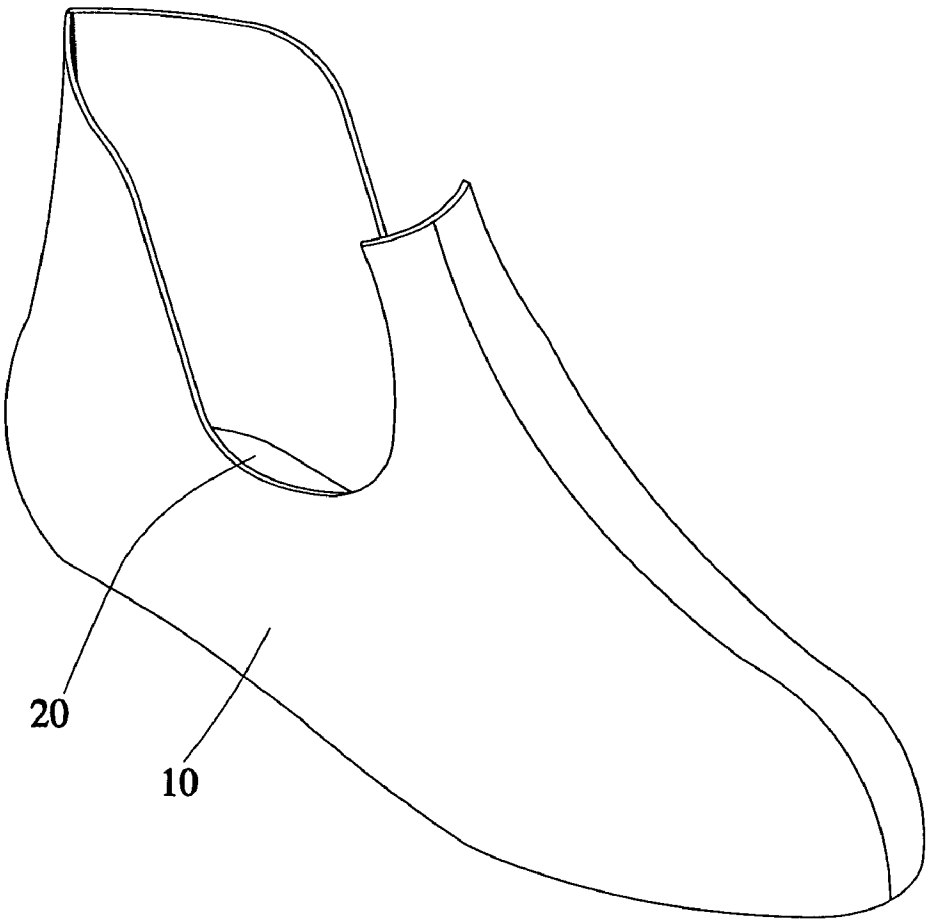
FIG. 1 is an elevation view of a waterproof and breathable insole in accordance with a first embodiment of the present invention.
Figure 2:
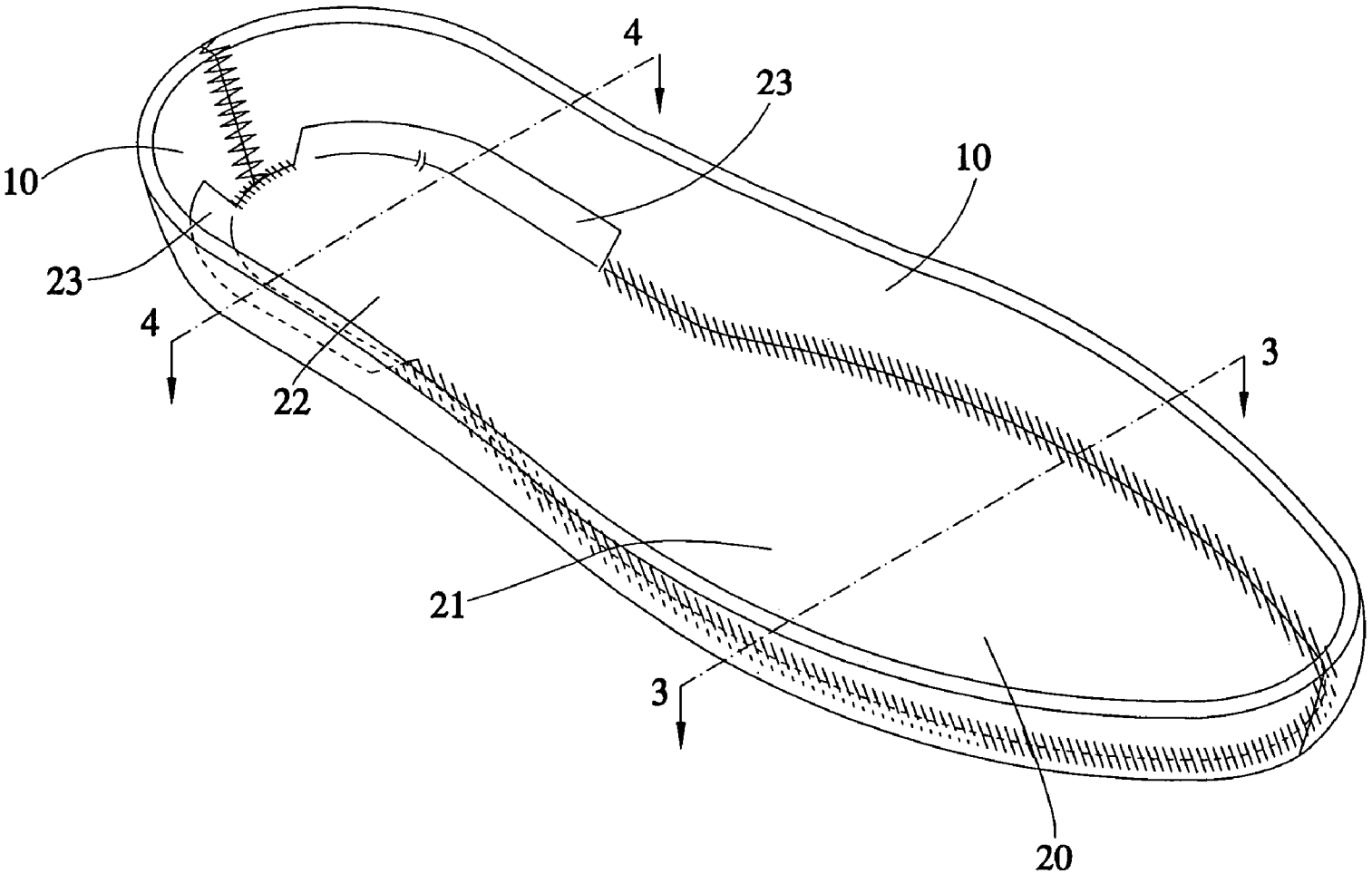
FIG. 2 is a perspective view of the waterproof and breathable insole according to the first embodiment of the present invention.
Figure 3:
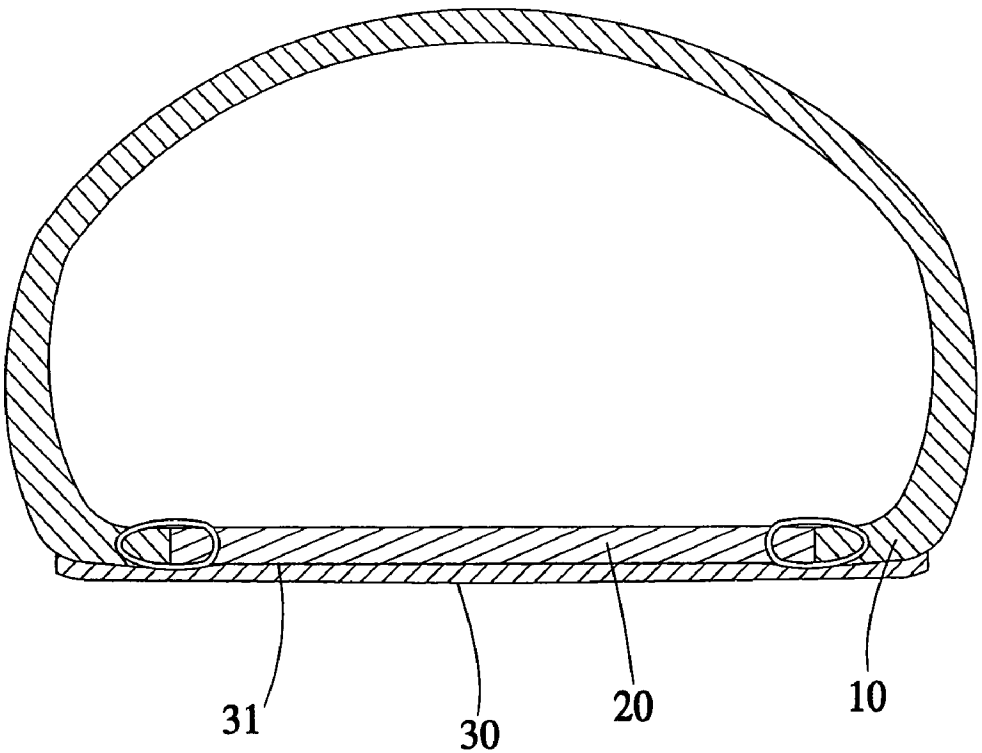
FIG. 3 is a cross-sectional view of the toe box part of the waterproof and breathable insole according to the first embodiment of the present invention.
Figure 4:
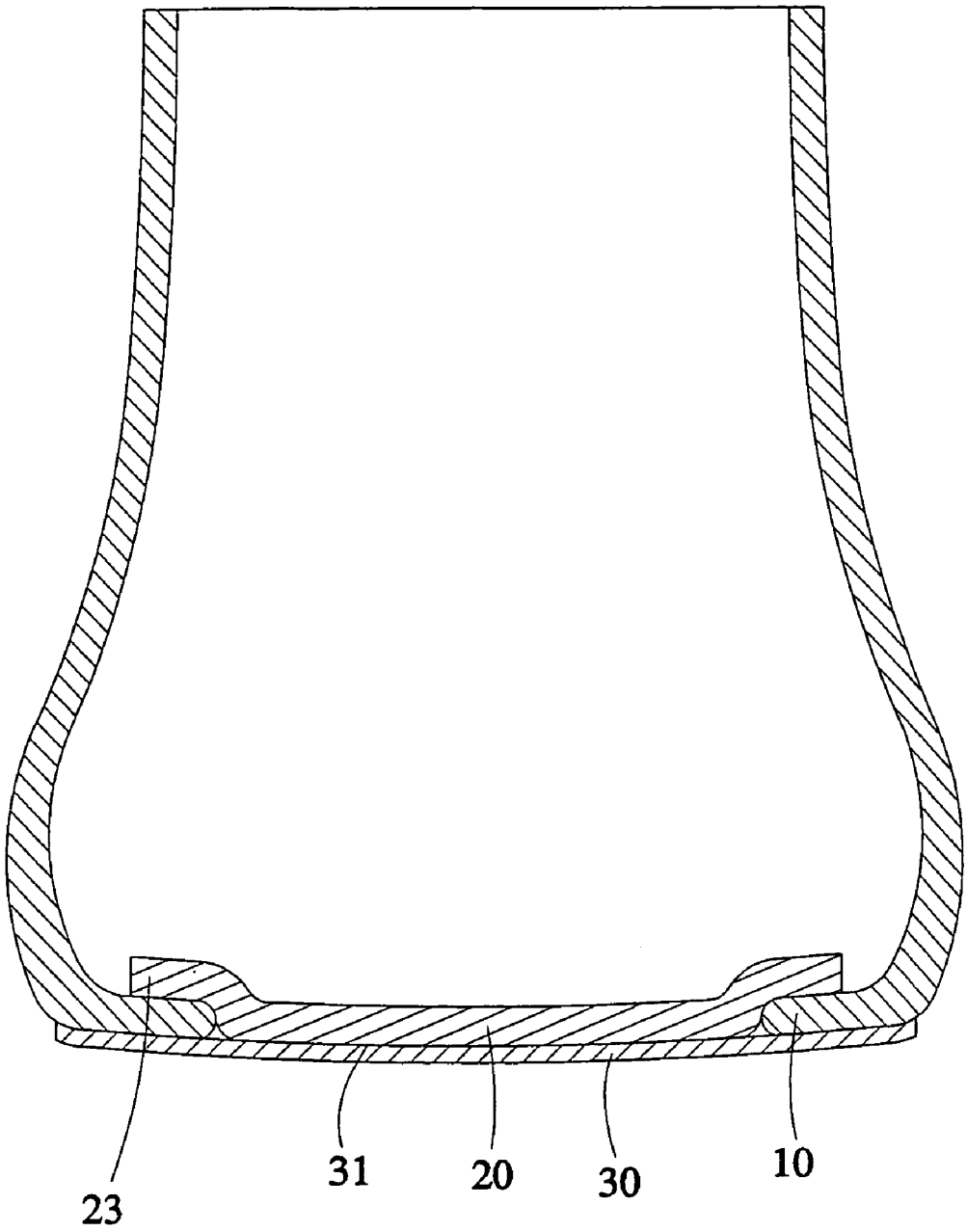
FIG. 4 is a cross-sectional view of the heel part of the waterproof and breathable insole according to the first embodiment of the present invention.

Referring to FIGS. 1-4, a waterproof and breathable insole in accordance with a first embodiment of the present invention is shown comprising a shoe lining 10, an insole 20, and a pad 30.

The shoe lining 10 can be made of any of a variety of materials such as cloth, genuine leather, synthetic leather, or synthetic fibers.

The insole 20 has a flat elongated insole body 21, and a rear heel portion 22 extending backwards from the flat elongated insole body 21 on the same plane. The flat elongated insole body 21 of the insole 20 fits the toes, transverse arch and plantar arch of the user's foot, and is peripherally stitched to the bottom edge of the shoe lining 10. The insole 20 further has two projections 23 disposed at two opposite lateral sides and respectively forwardly or backwardly extending along the two opposite side edges of the rear part of the flat elongated insole body 21 and the two opposite side edges of the rear heal portion 22. The rear part of the bottom edge of the shoe lining 10 is turned inwards and closely attached to the bottom side of the projections 23 of the insole 20 but not directly stitched to the insole 20. Therefore, gaps are left between the shoe lining 10 and the insole 20 around the projections 23 for ventilation. Further, the rear end of the real heal portion 22 is directly stitched to the rear part of the shoe lining 10.

The pad 30 is bonded to the whole area of the outside wall of the insole 20 with a layer of breathable glue 31 that is not waterproof. The pad 30 fits the configuration of the sole of the foot of a human being, and is relatively greater in size than the insole 20. The protruding part of the pad 30 over the border of the insole 20 is bonded to the shoe lining 10, keeping the bottom edge of the shoe lining 10 curved inwards and secured to the bottom side of the insole 20. The pad 30 is formed of a layer of non-woven fabric and a layer of waterproof and breathable material.

Because the pad 30 is formed of a layer of non-woven fabric and a layer of waterproof and breathable material, a soft bonding medium, i.e., a layer of non-waterproof and breathable glue 31 can be used to seal the pad 30 to the insole 20 and the shoe lining 10. Further, because the insole 20 around the two projections 23 is neither stitched nor bonded to the shoe lining 10, gaps are left in between the insole 20 and the shoe lining 10 for ventilation. Further, the bottom edge of the rear part of the shoe lining 10 is turned inwards and closely attached to the bottom side of the projections 23 of the insole 20. According to this design, the user's heel is only stepped on the insole far from the stitches between the pad 10 and the insole 20 and the stitches are not heavily stretched when the user is walking. Therefore, the service life of the shoe is greatly prolonged.

Figure 5:
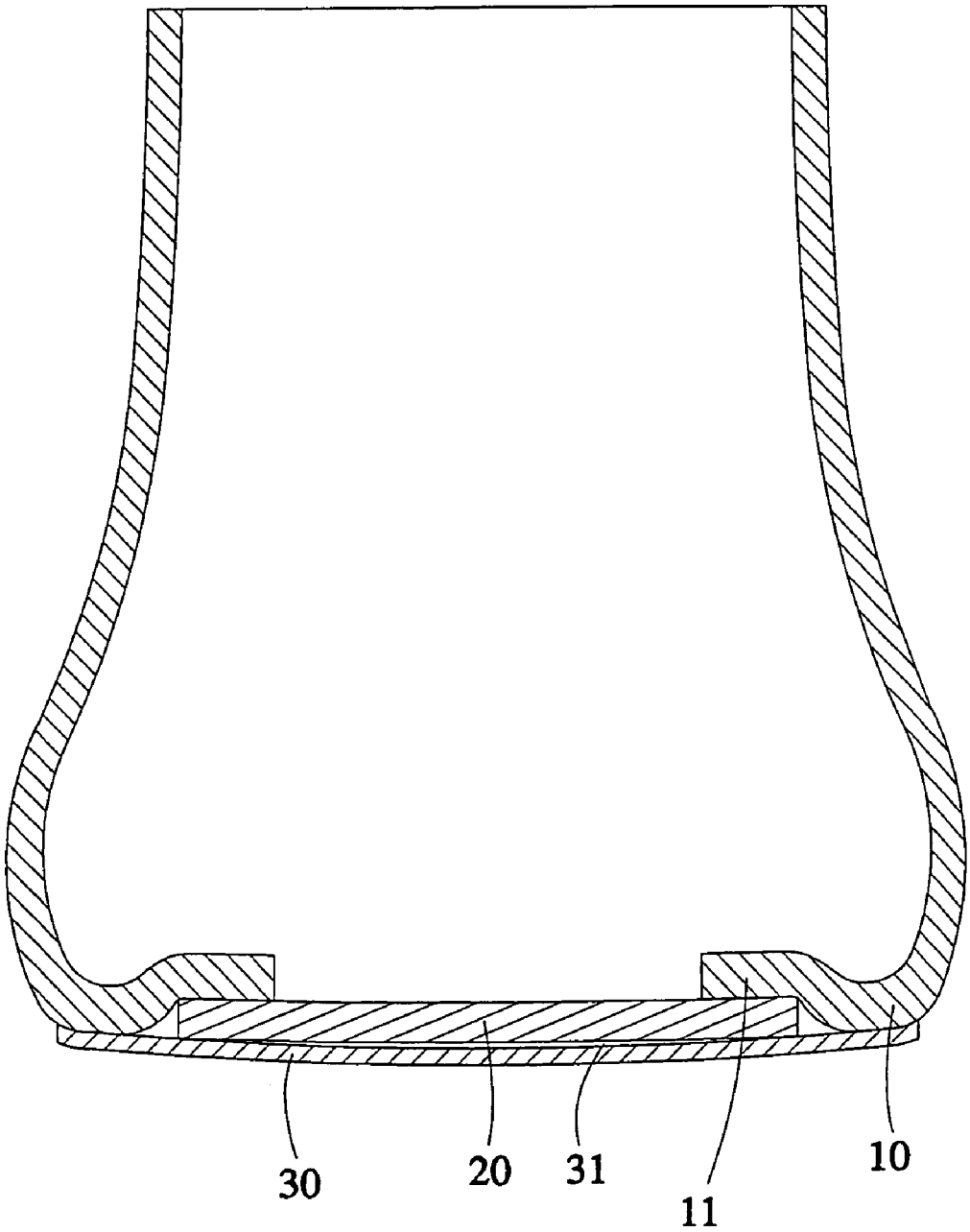
FIG. 5 is a cross-sectional view of the heel part of a waterproof and breathable insole in accordance with a second embodiment of the present invention.
Figure 6:
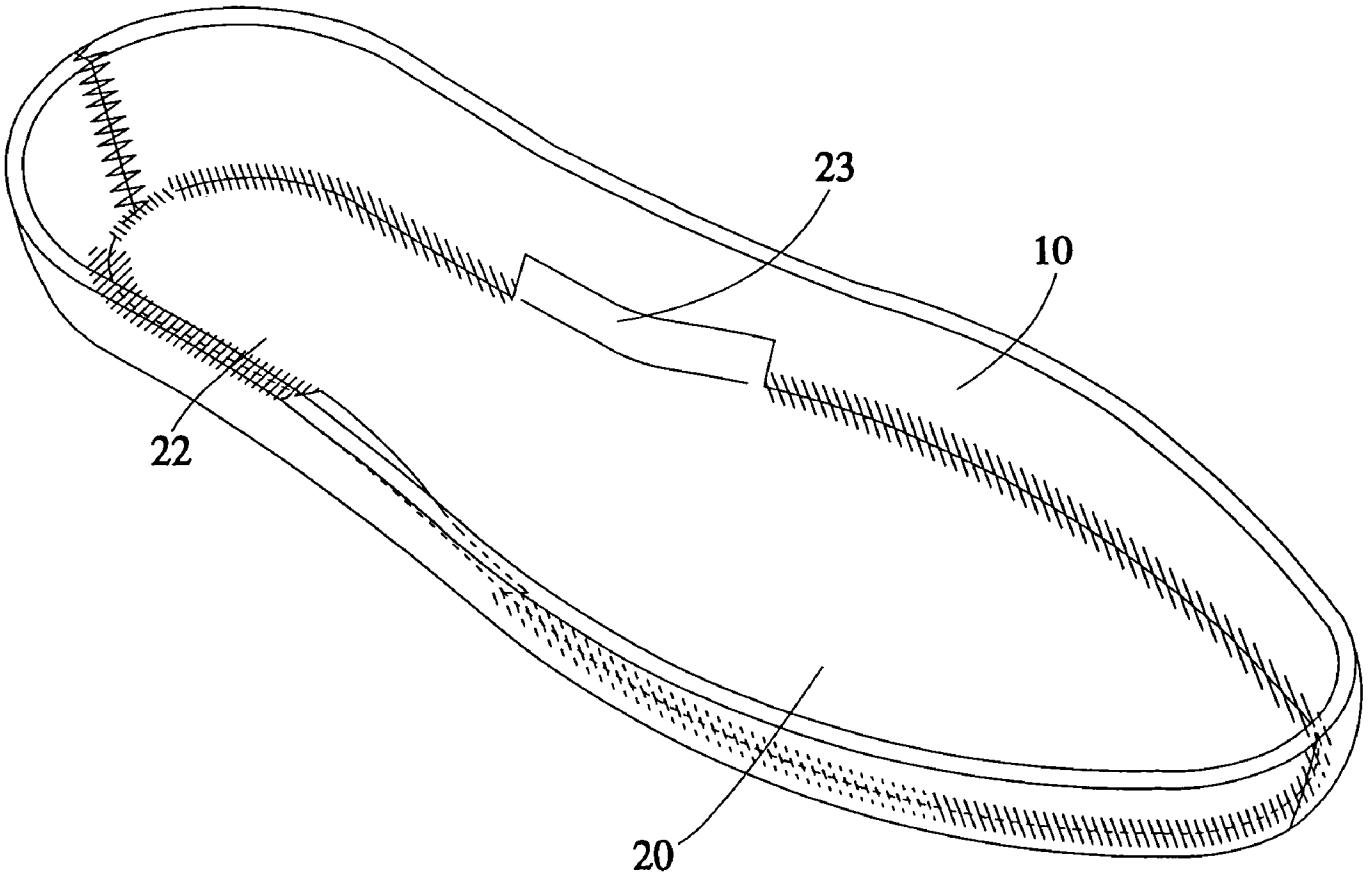
FIG. 6 is a perspective view of the waterproof and breathable insole in accordance with a third embodiment of the present invention.

In the aforesaid design, the bottom edge of the rear part of the shoe lining 10 is turned inwards and closely attached to the bottom side of the projections 23 of the insole 20. However, this design is not a limitation. FIG. 5 shows an alternate form of the present invention. According to this second embodiment, the insole 10 has two bottom projections 11 respectively attached to the top wall of the insole 20. This second embodiment achieves the same breathing effect. The locations of the projections 23 may be changed without departing from the spirit and scope of the invention. According to the third embodiment shown in FIG. 6, the projections 23 of the insole 20 are bilaterally disposed on the middle.

What is claimed is:

1. A waterproof and breathable insole comprising:

a shoe lining, said shoe lining having two bottom side edges respectively curved inwards;

an insole mounted inside said shoe lining, said insole having a flat elongated insole body fitting the toes, transverse arch and plantar arch of the user's foot and peripherally stitched to said shoe lining, a rear heel portion extending backwards from said flat elongated insole body, and two projections longitudinally arranged at two sides respectively attached to said bottom side edges of said shoe lining at a bottom side and defining with said bottom side edges of said shoe lining gaps for ventilation; and a pad bonded to the whole area of an outside wall of said insole and a part of said shoe lining with a layer of glue, said pad comprising a layer of waterproof and breathable material.

2. The waterproof and breathable insole as claimed in claim 1, wherein said insole has a rear end stitched to said shoe lining.

3. The waterproof and breathable insole as claimed in claim 1, wherein said pad further comprises at least one layer of non-woven fabric bonded to said layer of waterproof and breathable material.

4. The waterproof and breathable insole as claimed in claim 3, wherein said pad comprises two said layers of non-woven fabric respectively bonded to two opposite sides of said layer of waterproof breathable material.

5. The waterproof and breathable insole as claimed in claim 1, wherein said layer of glue is a non-waterproof and breathable glue.

6. A waterproof and breathable insole comprising:

a shoe lining, said shoe lining having two bottom projections respectively extended from two opposite bottom side edges thereof;

an insole, said insole having a flat elongated insole body fitting the toes, transverse arch and plantar arch of the user's foot and peripherally stitched to said shoe lining, a rear heel portion extending backwards from said flat elongated insole body, and a non-stitch border part attached to a bottom side of the bottom projections of said shoe lining for ventilation of air through gaps in between said border part of said insole and said bottom projections of said shoe lining; and a pad bonded to the whole area of an outside wall of said insole and a part of said shoe lining with a layer of glue, said pad comprising a layer of waterproof and breathable material.

7. The waterproof and breathable insole as claimed in claim 6, wherein said insole has a rear end stitched to said shoe lining.

8. The waterproof and breathable insole as claimed in claim 6, wherein said pad further comprises at least one layer of non-woven fabric bonded to said layer of waterproof and breathable material.

9. The waterproof and breathable insole as claimed in claim 8, wherein said pad comprises two said layers of non-woven fabric respectively bonded to two opposite sides of said layer of waterproof and breathable material.

10. The waterproof and breathable insole as claimed in claim 6, wherein said layer of glue is a non-waterproof and breathable glue.

* * * * *

UNITED STATES PATENT AND TRADEMARK OFFICE

CERTIFICATE OF CORRECTION

PATENT NO. : 7,543,398 B2
APPLICATION NO. : 11/355184
DATED : June 9, 2009
INVENTOR(S) : Chung-Hu Hsaio et al.

It is certified that error appears in the above-identified patent and that said Letters Patent is hereby corrected as shown below:

Title Page
Item 73, "MJC Probe Incorporation, Hsinchu Hsian (TW)," should read --Tiong Liong Industrial Co., Ltd., Taichung Hsien, (TW)--.

Signed and Sealed this

Twenty-second Day of December, 2009

David J. Kappos

David J. Kappos
*Director of the United States Patent and Trademark Office*